US005398646A

United States Patent [19]

Kuroshita et al.

[11] Patent Number: 5,398,646

[45] Date of Patent: Mar. 21, 1995

[54] EXHAUST ARRANGEMENT FOR A 2-CYCLE ENGINE

[75] Inventors: Kazuhisa Kuroshita, Hyogo; Shinji Shuto, Kakogawa, both of Japan

[73] Assignee: Kawasaki Jukogyo Kabushiki Kaisha, Kobe, Japan

[21] Appl. No.: 118,655

[22] Filed: Sep. 10, 1993

[30] Foreign Application Priority Data

Sep. 16, 1992 [JP] Japan ..... 4-064509[U]

[51] Int. Cl.[6] ..... F02B 75/02

[52] U.S. Cl. ..... 123/65 PE; 123/65 PD

[58] Field of Search ..... 123/65 PE, 65 P, 65 PD, 123/45 A, 193.2, 193.4, 193.5

[56] References Cited

U.S. PATENT DOCUMENTS

| | | | |
|---|---|---|---|
| 4,458,636 | 7/1984 | Kania | 123/65 P |
| 4,557,227 | 12/1985 | Woodard | 123/193.2 |
| 4,566,409 | 1/1986 | Yashiro et al. | 123/65 PE |
| 4,643,140 | 2/1987 | Whipple | 123/65 P |
| 4,651,686 | 3/1987 | Kania | 123/65 P |
| 5,054,441 | 10/1991 | Nakatani et al. | 123/65 P |
| 5,086,734 | 2/1992 | Nakai | 123/65 PE |

FOREIGN PATENT DOCUMENTS

| | | | |
|---|---|---|---|
| 54-156019 | 10/1979 | Japan . | |
| 0958671 | 9/1982 | U.S.S.R. | 123/65 PE |

*Primary Examiner*—Andrew M. Dolinar
*Assistant Examiner*—M. Macy
*Attorney, Agent, or Firm*—Leydig, Voit & Mayer

[57] ABSTRACT

An exhaust port is formed in the wall of a cylinder of a 2-cycle engine. At least one of the portions of the cylinder wall which define two vertically opposing edges of the exhaust port is projected at the circumferentially mid portion towards the opposing edge so as to provide a piston guide surface which conforms with the inner peripheral surface of the cylinder and which extends in such a manner as to reduce the axial height of the exhaust port. The piston guide surface serves to suppress vibration and noise caused when an upwardly moving piston falls into the exhaust port.

12 Claims, 4 Drawing Sheets

EXHAUST ARRANGEMENT FOR A 2-CYCLE ENGINE

BACKGROUND OF THE INVENTION

1. Field of the Invention

The present invention relates to a 2-cycle internal combustion engine and, more particularly, to an improvement in the configuration of an exhaust port of a 2-cycle internal combustion engine.

2. Description of the Related Art

FIG. 8 is a vertical sectional view of a 2-stroke motorcycle engine having a cylinder which is inclined forwardly and which is equipped with an exhaust port of a conventional configuration. As shown in this figure, an exhaust port 11 is formed so as to open in the front portion of the inner peripheral surface of the cylinder 1 which is inclined forwardly. The exhaust port is connected, through an exhaust passage 12 formed in the cylinder wall, to an exhaust pipe (not shown) which is connected to a front part of the cylinder. The engine has a crankshaft 9 which rotates in the direction of arrow R.

As shown in FIG. 9 or 10, the exhaust port 11 has an elliptic or rectangular form.

Referring again to FIG. 8, the engine has a piston 5 which is shown in its upward stroke. In this state, a connecting rod 8 is inclined such that its big end is positioned at the rear side of an axis C1 of the cylinder 1. Consequently, the piston 5 also is inclined with respect to the cylinder axis C1 in the same direction as the direction of inclination of the connecting rod 8. Therefore, the front side of the piston 5 makes contact with the inner peripheral surface 3 of the cylinder at a point or portion P1 which is intermediate between the top and bottom ends of the piston 5, while the rear side of the piston 5 contacts with the cylinder inner peripheral surface 3 at the bottom end portion P2.

In operation, the portion P1 of the piston 5 falls into the exhaust port 11 immediately after it passes the lower edge of the exhaust port 11 during an upward stroke of the piston 5. The portion P1 then collides with the upper edge of the exhaust port 11 as a result of further upward movement of the piston 5. Consequently, an annoying rattling noise is generated during the operation of the engine.

FIG. 11 is a chart showing the levels of vibration and noise as measured at a position S shown in FIG. 8. The upper part of the chart shows the timing or piston position in terms of pulses generated in response to detection of TDC (Top Dead Center), while the lower part of FIG. 11 shows the level of the measured noise. The middle part of FIG. 11 shows the level of vibration.

The falling of the portion P1 of the piston 5 into the exhaust port 11 takes place when the piston is at $\theta°$ before TDC so that a vibration takes place as indicated at X in the middle part of FIG. 11. A striking noise is then generated with a slight delay after the vibration, as indicated by Y in the lower part of FIG. 11.

The impact generated as a result of falling of the piston into the exhaust port and consequent vibration and noise are large particularly in a 2-cycle motorcycle engine which has a forwardly inclined cylinder.

Japanese Utility Model Unexamined Publication No. 54-156019 discloses an exhaust port configuration in which a vertical elongated rib, having a scavenging port, is provided at the center of the suction port. The piston, however, never falls into the scavenging port due to the specific relation between the port position and the direction of crankshaft rotation. Thus, the rib merely serves to provide a scavenging port, and is not intended to provide means preventing the piston from falling into an exhaust port.

SUMMARY OF THE INVENTION

Accordingly, an object of the present invention is to provide an improved exhaust arrangement for a 2-cycle engine, thereby suppressing generation of rattling noises peculiar to 2-cycle engines.

To this end, according to the present invention, there is provided an exhaust arrangement for a 2-cycle engine, wherein at least one of the portions of the cylinder wall defining the vertically opposing end edges of the exhaust port is projected locally, e.g., at the circumferential mid part, so as to provide a piston guide surface which projects towards the opposing end edge of the exhaust port and which is curved in conformity with the curvature of the inner peripheral surface of the cylinder.

DESCRIPTION OF THE PREFERRED EMBODIMENT

Figure 1:
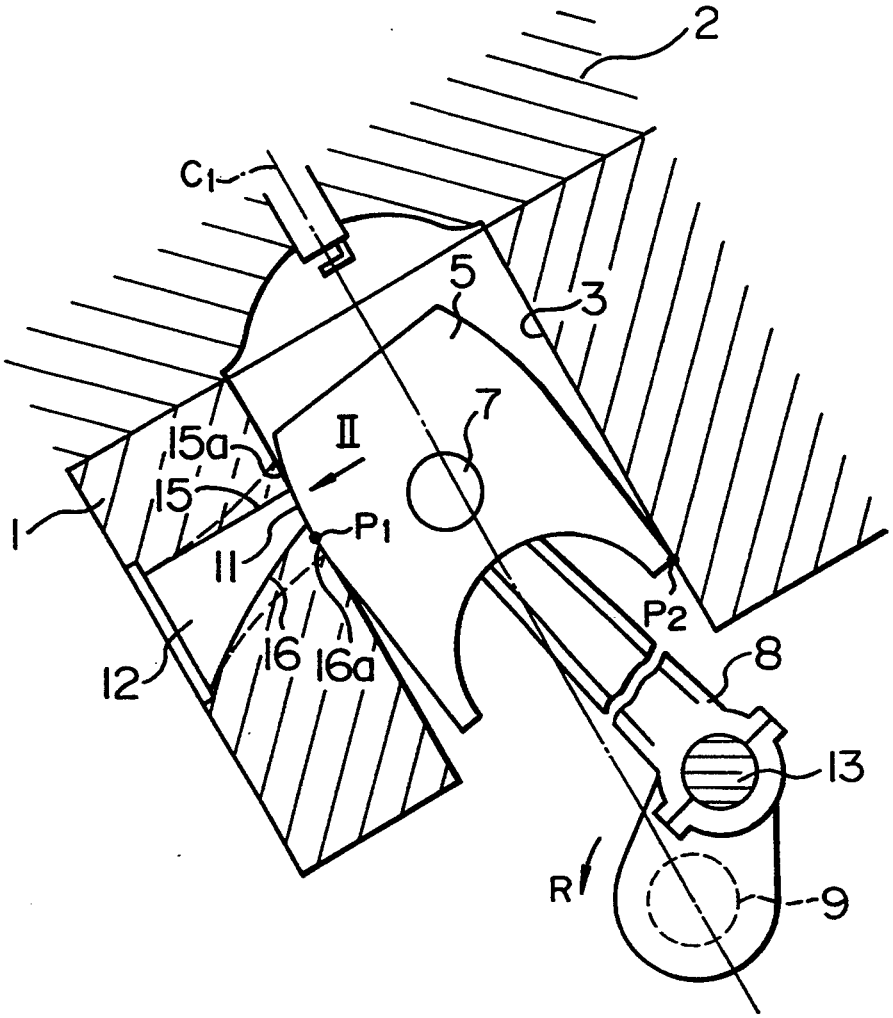
FIG. 1 is a vertical sectional view of a 2-cycle engine having an exhaust port configured in accordance with the present invention.

FIG. 1 is a vertical sectional view of a 2-cycle motorcycle engine with a forwardly inclined cylinder having an exhaust port configured in accordance with the present invention. The cylinder 1 is inclined forwardly, i.e., such that the top end of the cylinder is disposed on the front side of an imaginary vertical plane passing through the heightwise center of the cylinder. An exhaust passage 12 formed in the front portion of the wall of the cylinder 1 extends rearward so as to open in the inner peripheral surface 3 of the cylinder, thus forming an exhaust port 11. The exhaust passage 12 is connected at its front end to an exhaust pipe which is not shown.

The cylinder 1 receives a piston 5 which moves in sliding contact with the inner peripheral surface 3 of the cylinder 1. The piston 5 is connected to a crank pin 13 of a crankshaft 9 via a piston pin 7, a connecting rod 8, and so forth. The crankshaft 9 rotates in the direction of arrow R.

The portions of the cylinder wall defining the exhaust port 11 from an upper piston guide surface 15*a* which extends downward from the upper edge of the exhaust port 11 in parallel with the cylinder axis C1 and a lower piston guide surface 16*a* which extends upward from the lower edge of the exhaust port 11 in parallel with the cylinder axis C1. The upper and lower guide surfaces 15*a* and 16*a* are curved in conformity with the curvature of the cylindrical inner surface of the cylinder. Numerals 15 and 16 denote portions of the cylinder wall which form the above-mentioned guide surfaces 15*a* and 16*a*.

Figure 2:
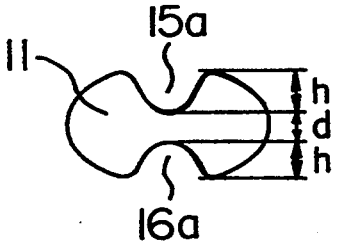
FIG. 2 is a developed view of the exhaust port as viewed in the direction of arrow II in FIG. 1.

Referring to FIG. 2 which is a developed view of the exhaust port 11 as viewed in the direction of arrow II in FIG. 1, the exhaust port 11 has a generally elliptic form with a horizontal major axis and is contracted at its horizontal or circumferential mid portion by the guide surfaces 15*a*, 16*a*. Thus, the upper and lower guide surfaces 15*a* and 16*a* are positioned at the circumferentially central portion of the exhaust port 11 and project downward, and upward to oppose each other by the same projection height "h", thus defining a restricted narrow gap "d" at the heightwise mid portion of the exhaust port 11.

Each of the guide surfaces 15*a* and 16*a* has a semi-circular or rounded mountain shape.

Figure 9:
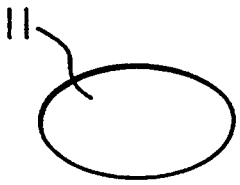
FIG. 9 PRIOR ART
FIG. 9 is a developed view as viewed in the direction of arrow IX in FIG. 8.
Figure 10:
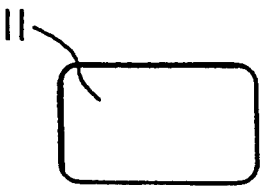
FIG. 10 PRIOR ART
FIG. 10 is a developed view similar to FIG. 9, showing another conventional exhaust port configuration.
Figure 11:
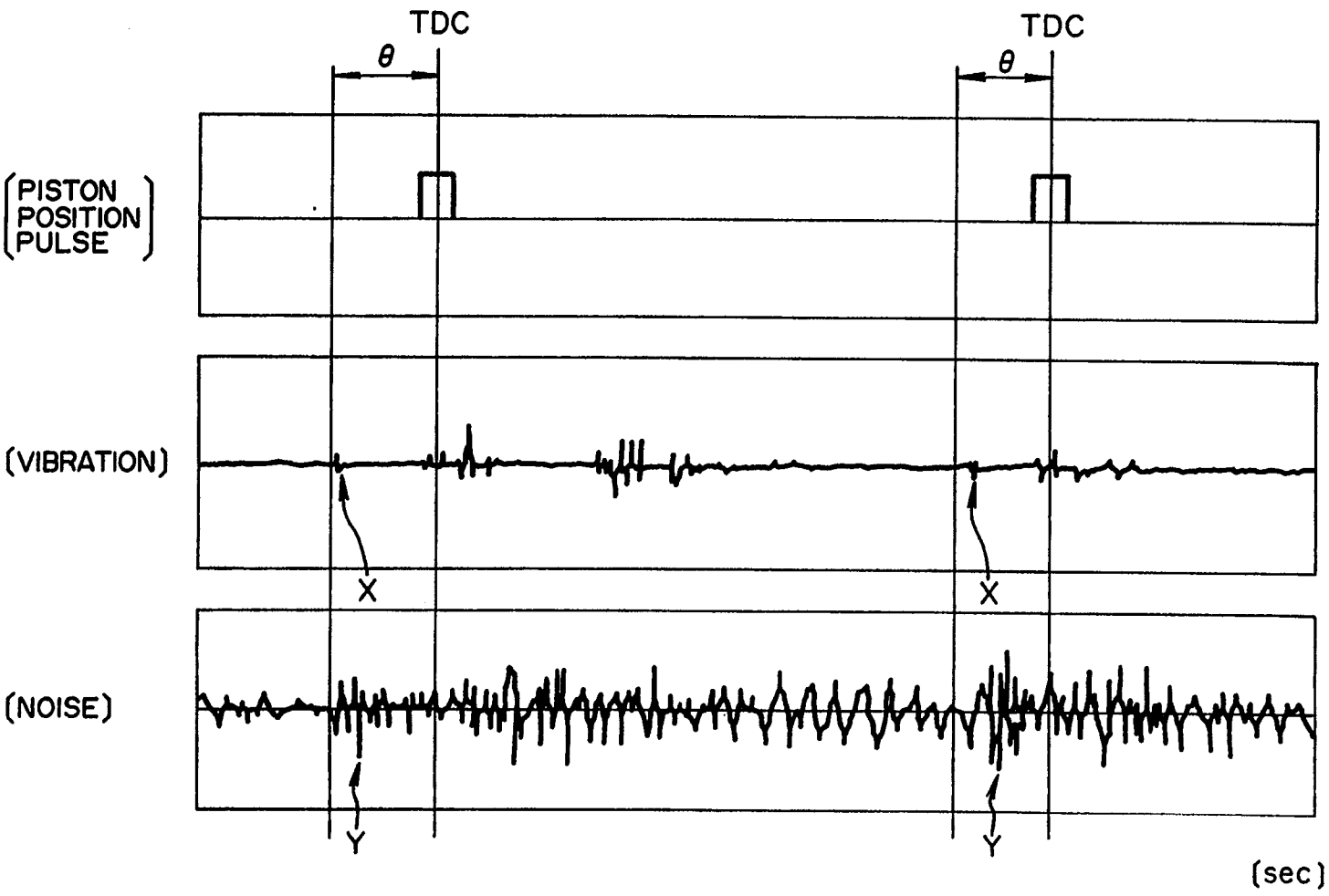
FIG. 11 PRIOR ART
FIG. 11 is a chart showing levels of vibration and noise as measured on a conventional 2-cycle engine.

In order that the illustrated exhaust port 11 provides the same cross-sectional area of gas passage as that provided by the exhaust port of the conventional configuration shown in FIG. 9, the exhaust port 11 shown in FIG. 2 has a greater axial height and circumferential length than the exhaust port of FIG. 9 so as to compensate for the reduction in the area caused by the provision of the upper and lower guide surfaces 15*a*, 16*a*.

In FIG. 1 the piston 5 is shown in its upward stroke. In this state, the connecting rod 8 is inclined such that its big end is positioned at the rear side of the axis C1 of the cylinder 1. Consequently, the piston 5 also is inclined with respect to the cylinder axis C1 in the same direction as the direction of inclination of the connecting rod 8. Thus, the front side of the piston 5 makes contact with the inner peripheral surface 3 of the cylinder at a point or portion P1 which is intermediate between the top and bottom ends of the piston 5, while the rear side of the piston 5 contacts with the cylinder inner peripheral surface 3 at the bottom end portion P2.

In the illustrated embodiment, the portion P1 of the piston 5 is still held and guided by the lower guide surface 16*a* even after passing the lower edge of the exhaust port 11 and is transferred to the upper guide surface 15*a* before it reaches the upper edge of the exhaust port 11. Consequently, the amount by which the piston 5 falls into the exhaust port 11 is greatly reduced so as to remarkably suppress vibration and noise generated as a result of such falling of the piston.

Modifications of the described exhaust port configuration will be described with reference to FIGS. 3 to 7.

Figure 3:
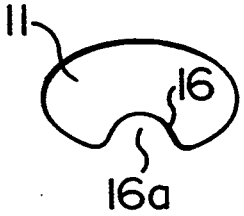
FIG. 3 is a developed view similar to that in FIG. 2, showing a first modification of the exhaust port configuration.

Referring to FIG. 3, the exhaust port 11 has a generally elliptic form but the portion of the cylinder wall defining the lower edge of the exhaust port 11 is projected upward as at 16 so as to provide a lower piston guide surface 16*a* similar to that of the embodiment shown in FIG. 2. In this modification, however, the cylinder wall portion defining the upper edge of the exhaust port 11 is not projected downward. Thus, the illustrated modification is devoid of the upper piston guide surface. This modification provides the advantage that a higher exhaust discharge efficiency is obtained particularly in the beginning of the exhaust stroke, considering that the discharge of the exhaust gas is commenced when the downwardly moving piston has passed the upper edges of the exhaust port 11, although the effect of suppressing vibration and noise is rather inferior to that of the embodiment shown in FIG. 2.

Figure 4:
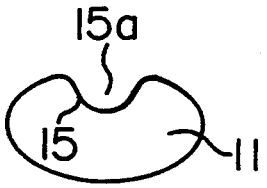
FIG. 4 is a developed view similar to that in FIG. 2, showing a second modification of the exhaust port configuration.

FIG. 4 shows another modification in which a guide surface 15*a* is provided only at the upper side of a generally elliptic exhaust port 11.

Figure 5:
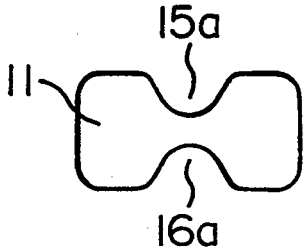
FIG. 5 is a developed view similar to that in FIG. 2, showing a third modification of the exhaust port configuration.

FIG. 5 shows still another modification in which upper and lower guide surfaces 15*a* and 16*a* similar to those of the embodiment shown in FIG. 2 are provided on the upper and lower sides of a substantially rectangular exhaust port 11.

Figure 6:
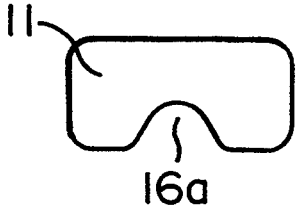
FIG. 6 is a developed view similar to that in FIG. 2, showing a fourth modification of the exhaust port configuration.

FIG. 6 shows a further modification in which only the portion 16 of the cylinder wall is projected so as to provide a guide surface 16*a* only on the lower edge of a generally rectangular exhaust port 11.

Figure 7:
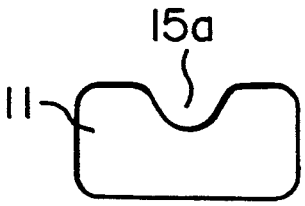
FIG. 7 is a developed view similar to that in FIG. 2, showing a fifth modification of the exhaust port configuration.
Figure 8:
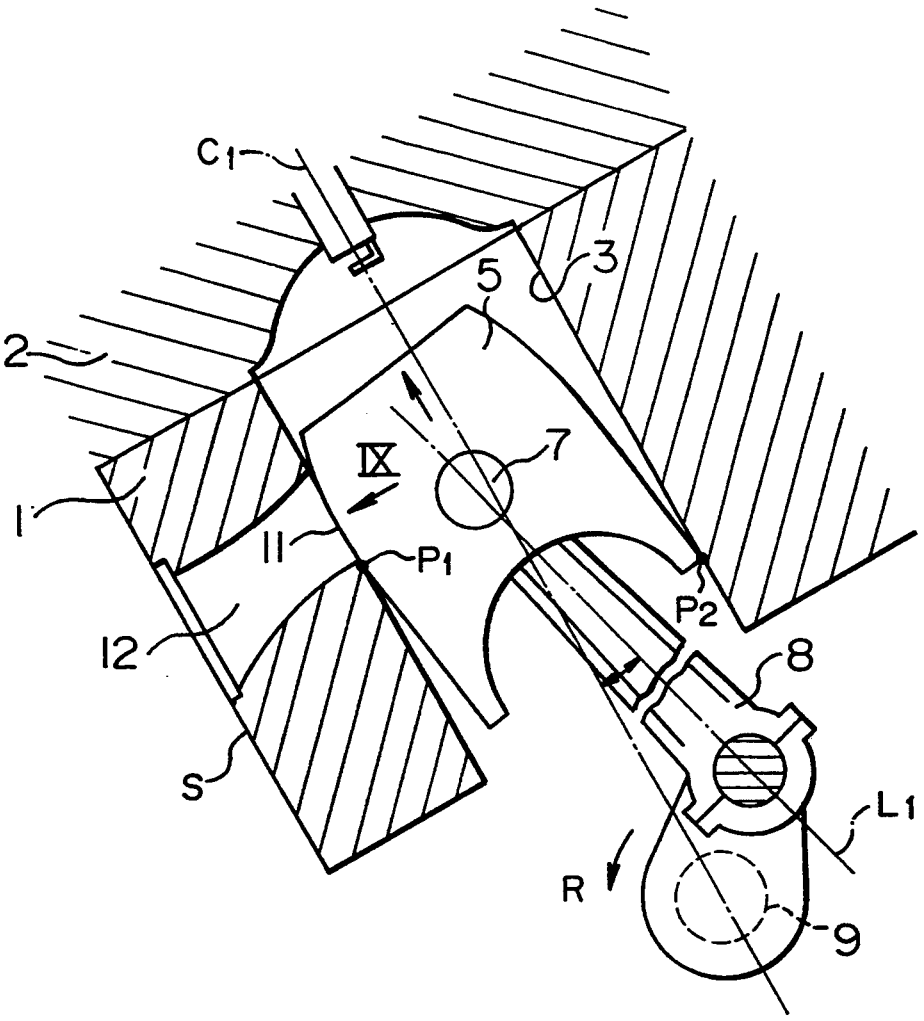
FIG. 8 PRIOR ART
FIG. 8 is a vertical sectional view of a conventional 2-cycle engine.

FIG. 7 shows a further modification in which only the portion 15 of the cylinder wall is projected so as to provide a guide surface 15*a* only on the upper edge of a generally rectangular exhaust port 11.

Although an engine having a forwardly inclined cylinder has been specifically mentioned, it will be clear that the invention can be also applied to engines having vertical or horizontal cylinders.

As has been described, according to the invention, an exhaust port which opens in the inner peripheral surface of the cylinder of a 2-cycle engine has such a configuration that at least one of the portions of the cylinder wall defining the vertically opposing edges of the exhaust port is locally projected so as to provide a piston guide surface which projects towards the opposing edge of the exhaust port and which is curved in conformity with the curvature of the inner peripheral surface of the cylinder. The piston guide surface effectively reduces the falling into the exhaust port of the piston which is inclined with respect to the cylinder axis in conformity with the inclination of the connecting rod, thereby suppressing generation of noise.

The problem concerning generation of vibration and noise due to falling of the piston into the exhaust port is serious particularly in 2-cycle engines with forwardly inclined cylinders, such as motorcycle engines. Thus, the advantages of the present invention are fully enjoyed when the invention is applied to 2-cycle engines having forwardly inclined cylinders.

It is also to be noted that the opposing edges of the guide surfaces are not connected to each other, thus avoiding problems such as seizure which may occur when these end edges are connected to each other.

What is claimed is:

1. An exhaust arrangement for a 2-cycle internal combustion engine comprising:

a cylinder having an axial direction and a circumferential direction and a cylinder wall and an open end for receiving a piston; and an exhaust port formed in the cylinder wall and having first and second opposing edges spaced in the axial direction of the cylinder and having a first projecting portion projecting from the first edge towards the second edge and away from the open end to locally reduce the height of the exhaust port in the axial direction and form a first piston guide surface.

2. An exhaust arrangement according to claim 1 wherein the exhaust port has widthwise ends and the first projecting portion is disposed substantially midway between the widthwise ends.

3. An exhaust arrangement according to claim 1 wherein the exhaust port has generally a shape along its first and second edges of an ellipse with a major axis extending in the circumferential direction of the cylinder.

4. An exhaust arrangement according to claim 2 wherein the exhaust port has generally a shape along its first and second edges of an ellipse with a major axis extending in the circumferential direction of the cylinder.

5. An exhaust arrangement according to claim 1 wherein the exhaust port has generally a shape of a rectangle with a major axis extending in the circumferential direction of the cylinder.

6. An exhaust arrangement according to claim 2 wherein the exhaust port has generally a shape of a rectangle with a major axis extending in the circumferential direction of the cylinder.

7. An exhaust arrangement according to claim 1 including a second projecting portion projecting from the second edge towards the first edge to form a second piston guide surface opposing the first piston guide surface and having the same shape as the first piston guide surface.

8. An exhaust arrangement according to claim 8 including a second projecting portion projecting from the second edge towards the first edge to form a second piston guide surface opposing the first piston guide surface and having the same shape as the first piston guide surface.

9. An exhaust arrangement according to claim 3 including a second projecting portion projecting from the second edge towards the first edge to form a second piston guide surface opposing the first piston guide surface and having the same shape as the first piston guide surface.

10. An exhaust arrangement according to claim 4 including a second projecting portion projecting from the second edge towards the first edge to form a second piston guide surface opposing the first piston guide surface and having the same shape as the first piston guide surface.

11. An exhaust arrangement according to claim 5 including a second prospecting portion projecting from the second edge towards the first edge to form a second piston guide surface opposing the first piston guide surface and having the same shape as the first piston guide surface.

12. An exhaust arrangement according to claim 6 including a second projecting portion projecting from the second edge towards the first edge to form a second piston guide surface opposing the first piston guide surface and having the same shape as the first piston guide surface.

* * * * *

UNITED STATES PATENT AND TRADEMARK OFFICE

CERTIFICATE OF CORRECTION

PATENT NO. : 5,398,646

DATED : March 21, 1995

INVENTOR(S) : Mori et al.

It is certified that error appears in the above-indentified patent and that said Letters Patent is hereby corrected as shown below:

Column 6, Line 1, change "8" to --2--.

Signed and Sealed this

Twenty-first Day of November, 1995

*Attest:*

BRUCE LEHMAN

*Attesting Officer*

*Commissioner of Patents and Trademarks*